United States Patent [19]

Brandis et al.

[11] Patent Number: 4,604,147

[45] Date of Patent: Aug. 5, 1986

[54] METHOD OF MANUFACTURING PERMANENT MAGNETS

[75] Inventors: Helmut Brandis; Wolfgang Spyra, both of Krefeld, Fed. Rep. of Germany

[73] Assignee: Thyssen Edelstahlwerke AG, Krefeld, Fed. Rep. of Germany

[21] Appl. No.: 651,237

[22] Filed: Sep. 17, 1984

[30] Foreign Application Priority Data

Sep. 23, 1983 [DE] Fed. Rep. of Germany ..... 3334369

[51] Int. Cl.[4] ..... H01F 1/02

[52] U.S. Cl. ..... 148/102; 148/103; 148/31.57

[58] Field of Search ..... 148/102, 103, 108

[56] References Cited

U.S. PATENT DOCUMENTS

| | | | |
|---|---|---|---|
| 3,806,336 | 4/1974 | Kaneko et al. | 148/31.57 |
| 4,120,704 | 10/1978 | Anderson | 148/103 |
| 4,246,049 | 1/1981 | Bronner et al. | 148/103 |
| 4,305,764 | 12/1981 | Iwata | 148/102 |
| 4,366,007 | 12/1982 | Inoue | 148/103 |

FOREIGN PATENT DOCUMENTS

| | | | |
|---|---|---|---|
| 2149076 | 3/1973 | France . | |
| 53-57492 | 5/1978 | Japan | 148/103 |
| 57-92131 | 6/1982 | Japan | 148/108 |
| 59-107020 | 6/1984 | Japan | 148/103 |
| 541997 | 12/1941 | United Kingdom . | |
| 678449 | 9/1952 | United Kingdom . | |
| 817697 | 8/1959 | United Kingdom . | |
| 1013213 | 12/1965 | United Kingdom . | |

OTHER PUBLICATIONS

Jin, "Deformation-Induced Anisotropic Cr—Co—Fe Permanent Magnet Alloys", Proc. 2nd Joint Intermag MMM-Conf. Jul. 17-20, 1979.

Ikuta et al., "Single Crystal Magnets" J. Appl. Phys. 54(9), Sep. 1983, pp. 5400-5403.

Homma et al., "Fe—Cr—Co Permanent Magnet Alloys Heat-Treated in the Ridge Region of the Miscibility Gap", IEEE Trans. on Mag. vol. MAG-17, No. 6, Nov. 1981, pp. 3473-3478.

*Primary Examiner*—John P. Sheehan

*Attorney, Agent, or Firm*—Dennison, Meserole, Pollack & Scheiner

[57] ABSTRACT

An alloy is proposed for use in making permanent magnets. The alloy has the following composition by weight:

| | |
|---|---|
| Chromium | 22.5 to 25.5% |
| Cobalt | 15.0 to 17.5% |
| Molybdenum | 2.0 to 4.0% |
| Silicon | 0.1 to 0.8% |
| Oxygen | less than 0.10% |
| Effective carbon | less than 0.06% |
| Remainder | iron and unavoidable impurities, |

where effective carbon is defined as carbon content plus 0.86 times nitrogen content.

In a method of manufacturing permanent magnets, a workpiece is made of the alloy, for example by suction or extrusion casting, and the workpiece is subjected to a heat treatment comprising:

(a) a homogenizing annealing for 15 minutes to 3 hours at 1230° C. to 1280° C., followed by quenching in water or oil; and (b) a thermo-magnetic treatment for 10 to 30 minutes at 720° C. to 740° C., followed by the application for 10 to 120 minutes in a preferred axial direction of a magnetic field of 80 to 240 kA/m at a temperature of 630° C. to 650° C., followed by cooling in air.

The workpiece is then optionally age-hardened in the following three stages:

i maintaining the workpiece at 590° C. to 625° C. for 0.25 to 10 hours ii maintaining the workpiece at 555° C. to 585° C. for 0.5 to 30 hours, and iii maintaining the workpiece at 500° C. to 540° C. for 0 to 50 hours.

2 Claims, 2 Drawing Figures

METHOD OF MANUFACTURING PERMANENT MAGNETS

This invention relates to a method of manufacturing a permanent magnet and to an alloy for use in such a method, and extends to magnets made by such a method.

As early as 1936, W. Köster (German Patent Specification No. 638652) found that Fe—Cr—Co alloys containing 8 to 80% Co, 5 to 35% Cr, remainder Fe, show permanent magnetic properties, though not so good as those of Alnico magnets. Towards the end of the nineteen-sixties, Kaneko et al. (H. Kaneko, M. Homma, K. Nakamura and M. Miura: AJP-Conf. Proc. Vol. 5, P 2, 1971, pp 1088–92) showed that in Fe—Cr—Co alloys, just as in Alnico alloys, magnetic hardening takes place by the spinodal separation of ferrite.

Compared with the Alnico alloys, Fe—Cr—Co alloys provide economies in cobalt and nickel, higher yields due to greater ductility and both hot and cold workability before an aging treatment.

Magnetic materials can be made into final products by a number of different processes such as rolling, sintering and casting.

Although rolling is advantageous in series production, a number of preliminary steps are required, such as pouring to form ingots, forging, annealing and grinding. Hot deformation temperatures are limited to below 1100° C., due to a tendency for the alloy to form a brittle sigma phase.

Sintering allows complex shapes to be made in almost their final form, but the density of the product is less than that of a rolled product. The preparation of the sintering powder is costly, as is sintering in an atmosphere low in oxygen and nitrogen.

The casting of Alnico alloys is usually done in a mask mould, and due to the pouring system used, the yield is usually less than 60%. When Fe—Cr—Co alloys are cast by such a method, difficulties can arise due to the ductility of the alloy, in that the product can be difficult to separate from the pouring spout.

It is an object of the present invention to provide an industrially viable method of manufacturing permanent magnets using an alloy of the Fe—Cr—Co type in which these disadvantages are substantially avoided.

According to the present invention, there is provided a method of manufacturing a permanent magnet comprising forming a workpiece of an alloy having the following composition by weight:

| | |
|---|---|
| Chromium | 22.5 to 25.5% |
| Cobalt | 15.0 to 17.5% |
| Molybdenum | 2.0 to 4.0% |
| Silicon | 0.1 to 0.8% |
| Oxygen | less than 0.10% |
| Effective carbon | less than 0.06% |
| Remainder | iron and unavoidable impurities, |

where effective carbon is defined as carbon content plus 0.86 times nitrogen content, and subjecting the workpiece to a heat treatment comprising:

(a) a homogenising annealing for 15 minutes to 3 hours at 1230° C. to 1280° C., followed by quenching in liquid such as water or oil; and (b) a thermo-magnetic treatment for 10 to 30 minutes at 720° C. to 740° C., followed by the application for 10 to 120 minutes in a preferred axial direction of a magnetic field of 80 to 240 kA/m at a temperature of 630° C. to 650° C., followed by cooling in air.

The invention includes an alloy having the following composition by weight:

| | |
|---|---|
| Chromium | 22.5 to 25.5% |
| Cobalt | 15.0 to 17.5% |
| Molybdenum | 2.0 to 4.0% |
| Silicon | 0.1 to 0.8% |
| Oxygen | less than 0.10% |
| Effective carbon | less than 0.06% |
| Remainder | iron and unavoidable impurities, |

where effective carbon is defined as carbon content plus 0.86 times nitrogen content.

To obtain the best alloy it is necessary to find the values, particularly for chromium and cobalt, which give the highest coercive field strength. For stabilising the ferrite we have found that chromium around 23.5% and cobalt around 16% give the best results, because these elements unexpectedly have little influence on coercive field strength. The quantities of carbon, nitrogen, oxygen and silicon, which elements adversely influence magnetic properties are reduced as far as possible, save that a little silicon is retained for de-oxidising the melt.

In the most preferred embodiments of the method and of the alloy of the invention, said alloy has the following composition by weight:

| | |
|---|---|
| Chromium | 23.0 to 24.7% |
| Cobalt | 15.5 to 17.0% |
| Molybdenum | 2.0 to 3.5% |
| Silicon | 0.2 to 0.6% |
| Oxygen | less than 0.08% |
| Effective carbon | less than 0.06% |
| Remainder | iron and unavoidable impurities. |

In the method of the invention, the alloy, after forming into a workpiece, is subjected to a homogenising annealing treatment, in order to produce a purely ferritic phase and to impart the best magnetic properties thereto, whereafter the workpiece is quenched in water or oil. The homogenising annealing treatment specified is adapted to bring out these quantities. Preferably, said homogenising annealing treatment is effected for 30 to 60 minutes at 1250° C. to 1270° C., for example for 30 minutes at 1260° C.

The thermo-magnetic treatment required by the method of the invention for producing anisotropic magnetic properties by aligning the growth of ferro-magnetic separation zones in the magnetic field begins with a stress-relieving annealing. The workpiece may then be transferred to a magnetic-field furnace where spinodal separation induced. In preferred embodiments of the method of the invention, said thermo-magnetic treatment comprises maintaining the workpiece at 725° C. to 735° C. for 10 to 20 minutes, followed by applying to it for 20 to 80 minutes in a preferred axial direction, a magnetic field of 120 to 200 kA/m at a temperature of 635° C. to 645° C. In a specific advantageous embodiment, the workpiece is maintained at 730° C. for 15 minutes, whereafter a magnetic field of 160 kA/m at a temperature of 640° C. is applied to it for 60 minutes in the preferred axial direction.

In the most preferred embodiments of the method of the invention, the workpiece is subsequently age-hardened.

Age-hardening is performed at temperatures which hardly affect the anisotropic arrangement, formed at above 630° C., of the spinodally separated crystalline structure. It has been found that a magnetic field applied during the age-hardening does not improve the magnetic properties of the product. However, it has been found that, with decreasing age-hardening temperatures down to the diffusion limit of the substitution atoms, the miscibility gap causes an increase in the differences between the compositions of the iron- and cobalt-rich regions and the chromium-rich regions.

In order to avoid discontinuous separation at the grain boundaries and to prevent secondary separations in the separation regions, it is advisable to adjust the equilibrium concentration substantially to agree with the limits of the miscibility gap. For this purpose it has hitherto been supposed that the ideal age-hardening process would be an approximately continuous cooling in agreement with the formula:

$$\ln(C-t) \approx 1/T,$$

where t is duration, T is temperature and C is a constant. See S. Jin, G. Y. Chin and B. C. Wonsiewicz: JEEE-Trans. on Magnetics 16, 1980, pp 139/46. But it has now rather surprisingly been found that the Fe—Cr—Co alloy of the present invention shows the best permanent-magnet properties when, as is preferred, the workpiece is subsequently age-hardened in the following three stages:

i maintaining the workpiece at 590° C. to 625° C. for 0.25 to 10 hours
ii maintaining the workpiece at 555° C. to 585° C. for 0.5 to 30 hours, and
iii maintaining the workpiece at 500° C. to 540° C. for 0 to 50 hours.

Such a schedule has the additional advantage that it is easier to put into effect than the continuous cooling schedule referred to. In each of the stages referred to, it is desirable that within the ranges given, the greater the duration, the lower should be the temperature, and vice versa. If desired the workpiece may be cooled, for example air-cooled, between successive stages.

Advantageously, the workpiece is age-hardened in the following three stages:

i maintaining the workpiece at 595° C. to 605° C. for 0.5 to 1 hour
ii maintaining the workpiece at 560° C. to 570° C. for 1 to 20 hours, and
iii maintaining the workpiece at 500° C. to 530° C. for 0 to 30 hours.

Preferably, the workpiece is formed by suction casting or by extrusion casting. The alloy of the invention may be melted in an open vessel and poured under suction into, for example, a glass tube, or it may be extrusion cast into, for example, a copper-ingot mould. The suction casting method is particularly flexible in regard to the volume and dimensions of the product, whereas extrusion-casting has particular advantages of high yield and low labour costs.

The invention includes a permanent magnet made from a workpiece formed and treated by a method as herein defined, and in particular extends to such a magnet which has the following properties, measured in the direction of magnetisation;

coercive field strength $_BH_C$ at least 50 kA/m;
remanence Br at least 1.2 T; and
energy value $(BH)_{max}$ at least 39 kJ/m$^3$.

Various preferred embodiments of the invention will now be described by way of Example and with reference to the accompanying drawings in which:

FIG. 1 shows a polished cross section of a suction cast rod of an alloy according to the invention, and FIG. 2 shows a demagnetisation curve for the alloy of Example 5.

EXAMPLE 1

For comparison only, not according to this invention.

| Alloy composition | |
|---|---|
| Cr | 24% |
| Co | 16% |
| Si | 1% |
| Nb | 0.4% |
| V | 0.4% |
| Fe | substantially the balance |

Casting method: Extrusion casting.

Heat treatment

1240° for 60 minutes, followed by water quenching, then
740° for 15 minutes, and
640° for 60 minutes, with 160 kA/m, followed by air cooling, then
620° for 1 hour,
580° for 16 hours, and
540° for 48 hours, followed by air cooling.

Magnetic properties remanence Br 1.28 T;
coercive field strength $_BH_C$ 46 kA/m;
energy value $(BH)_{max}$ 37 kJ/m$^3$; and
curve filling coefficient $\eta$ 63%

EXAMPLE 2

According to this invention.

| Alloy composition | |
|---|---|
| Cr | 23.4% |
| Co | 15.8% |
| Mo | 2% |
| Si | 0.6% |
| Fe | substantially the balance |

Casting method: Suction casting.

Heat treatment: (As in Example 1)

1240° for 60 minutes, followed by water quenching, then
740° for 15 minutes, and
640° for 60 minutes, with 160 kA/m, followed by air cooling, then
620° for 1 hour,
580° for 16 hours, and
540° for 48 hours, followed by air cooling.

Magnetic properties:

remanence Br 1.27 T;
coercive field strength $_BH_C$ 52 kA/m;
energy value $(BH)_{max}$ 40 kJ/m$^3$; and
curve filling coefficient $\eta$ 60%

EXAMPLE 3

According to this invention.

| Alloy composition | |
|---|---|
| Cr | 23.5% |
| Co | 16% |
| Mo | 3% |
| Si | 0.3% |
| Fe | substantially the balance |

Casting method: Suction casting.

Heat treatment:

1260° for 30 minutes, followed by water quenching, then

730° for 15 minutes, and

640° for 60 minutes, with 160 kA/m, followed by air cooling, then

600° for 1 hour, followed by air cooling,

565° for 15 hours, followed by air cooling, and

520° for 24 hours, followed by air cooling.

Magnetic properties:

remanence Br 1.27 T;

coercive field strength $_BH_C$ 60.5 kA/m;

energy value $(BH)_{max}$ 45 kJ/m$^3$; and curve filling coefficient $\eta$ 59%

EXAMPLE 4

According to this invention.

| Alloy composition | |
|---|---|
| Cr | 23.5% |
| Co | 16% |
| Mo | 3% |
| Si | 0.3% |
| Fe | substantially the balance |

Casting method: Suction casting.

Heat treatment:

1260° for 30 minutes, followed by water quenching, then

730° for 15 minutes, and

640° for 60 minutes, with 160 kA/m, followed by air cooling, then

600° for 1 hour, followed by air cooling, and

565° for 20 hours, followed by air cooling.

Magnetic properties:

remanence Br 1.28 T;

coercive field strength $_BH_C$ 52.5 kA/m;

energy value $(BH)_{max}$ 40 kJ/m$^3$; and curve filling coefficient $\eta$ 60%

EXAMPLE 5

According to this invention.

| Alloy composition | |
|---|---|
| Cr | 23.5% |
| Co | 16.3% |
| Mo | 3% |
| Si | 0.29% |
| Fe | substantially the balance |

Casting method: Suction casting.

Heat treatment:

1260° for 60 minutes in argon, followed by water quenching, then

730° for 15 minutes, and

640° for 60 minutes, with 160 kA/m, followed by air cooling, then

620° for 1 hour,

580° for 16 hours, and

540° for 48 hours, followed by air cooling.

Magnetic properties:

remanence Br 1.33 T;

coercive field strength $_BH_C$ 56.6 kA/m;

energy value $(BH)_{max}$ 43. kJ/m$^3$; and curve filling coefficient $\eta$ 57.4%

Figure 1:
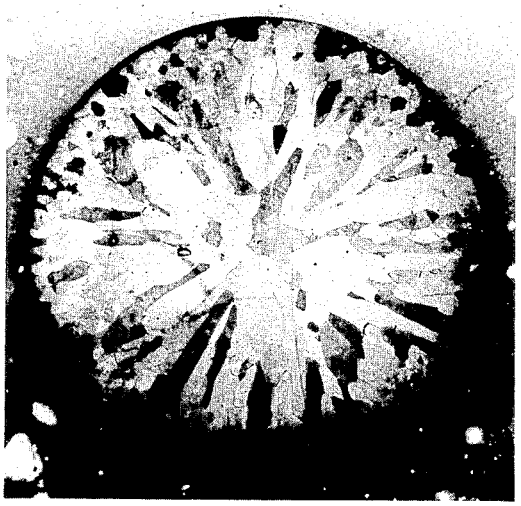
FIG. 1 shows a polished cross section of a suction cast rod of an Fe—Cr—Co—Mo alloy according to the invention, and illustrates how the crystals are partially oriented radially of the rod.
Figure 2:
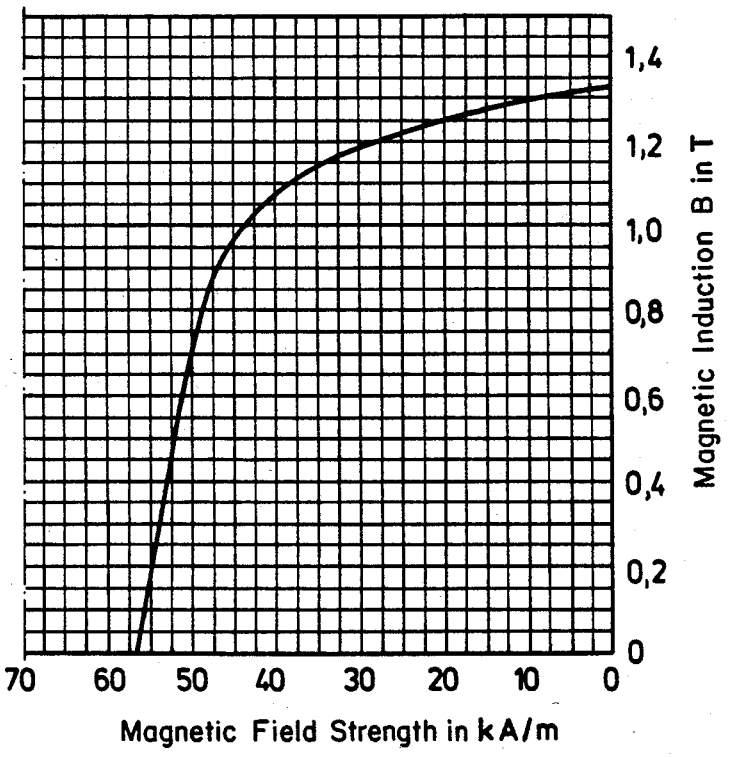
FIG. 2 shows a demagnetisation curve for the alloy of Example 5, the magnetic field strength being indicated in kiloamperes per meter, and the magnetic induction B being indicated in tesla (T).

What is claimed is:

1. A method of manufacturing a permanent magnet comprising forming a workpiece of an alloy having the following composition by weight:

| | |
|---|---|
| Chromium | 22.5 to 25.5% |
| Cobalt | 15.0 to 17.5% |
| Molybdenum | 2.0 to 4.0% |
| Silicon | 0.1 to 0.8% |
| Oxygen | less than 0.10% |
| Effective carbon | less than 0.06% |
| Remainder | iron and unavoidable impurities, |

where effective carbon is defined as carbon content plus 0.86 times nitrogen content, and subjecting the workpiece to:

(a) a homogenising annealing for 15 minutes to 3 hours at 1230° C. to 1280° C., followed by quenching in liquid; then to (b) a treatment comprising treating the workpiece for 10 to 30 minutes at 720° C. to 740° C., followed by the application for 10 to 120 minutes in a preferred axial direction of a magnetic field of 80 to 240 kA/m at a temperature of 630° C. to 650° C., followed by cooling in air; and subsequently to (c) an age-hardening treatment in the following stages:

(ci) maintaining the workpiece at 590° C. to 625° C. for 0.25 to 10 hours (cii) maintaining the workpiece at 555° C. to 585° C. for 0.5 to 30 hours, and (ciii) maintaining the workpiece at 500° C. to 540° C. for 0 to 50 hours; thereby to form a permanent magnet which has the following properties, measured in the direction of magnetisation;

coercive field strength $_BH_C$ at least 50 kA/m;

remanence Br at least 1.2 T; and energy value $(BH)_{max}$ at least 39 kJ/m$^3$.

2. A method of manufacturing a permanent magnet comprising forming a workpiece of an alloy having the following composition by weight:

| | |
|---|---|
| Chromium | 23.0 to 24.7% |
| Cobalt | 15.5 to 17.0% |
| Molybdenum | 2.0 to 3.5% |
| Silicon | 0.2 to 0.6% |
| Oxygen | less than 0.08% |
| Effective carbon | less than 0.06% |
| Remainder | iron and unavoidable impurities, |

where effective carbon is defined as carbon content plus 0.86 times nitrogen content, and subjecting the workpiece to:

(a) a homogenising annealing treatment for 30 to 60 minutes at 1250° C. to 1270° C., followed by quenching in liquid; then to (b) a treatment comprising maintaining the workpiece at 725° C. to 735° C. for 10 to 20 minutes, followed by applying to it for 20 to 80 minutes in a preferred axial direction, a magnetic field of 120 to 200 kA/m at a temperature of 635° C. to 645° C., followed by cooling in air; and subsequently to (c) an age-hardening treatment in the following stages:

(ci) maintaining the workpiece at 595° C. to 605° C. for 0.5 to 1 hour (cii) maintaining the workpiece at 560° C. to 570° C. for 1 to 20 hours, and (ciii) maintaining the workpiece at 500° C. to 530° C. for 0 to 30 hours; thereby to form a permanent magnet which has the following properties, measured in the direction of magnetisation;

coercive field strength $_BH_C$ at least 50 kA/m;

remanence Br at least 1.2 T; and energy value $(BH)_{max}$ at least 39 kJ/m$^3$.

* * * * *